United States Patent [19]

McClellan

[11] Patent Number: 4,870,771

[45] Date of Patent: Oct. 3, 1989

[54] REVOLVER HOLDER

[76] Inventor: Gary C. McClellan, 4011 Saddler La., Vale, Oreg. 97918

[21] Appl. No.: 344,664

[22] Filed: Apr. 28, 1989

[51] Int. Cl.[4] ..... A45C 11/00; F41C 33/00

[52] U.S. Cl. ..... 42/90; 42/106; 206/317; 224/163; 224/912; 24/163 K

[58] Field of Search ..... 42/70.11, 90, 94, 99, 42/106; 206/317; 224/163, 243, 244, 912; 211/64; 24/2.5, 3 R, 3 F, 163 K

[56] References Cited

U.S. PATENT DOCUMENTS

| | | | |
|---|---|---|---|
| 3,468,427 | 9/1969 | Leslie | 206/317 |
| 4,198,026 | 4/1980 | Capolupo | 42/70.11 |
| 4,260,087 | 4/1981 | Leaver | 224/912 |
| 4,299,045 | 11/1981 | Cervantes | 42/70.11 |
| 4,377,249 | 3/1983 | Bockoven | 224/163 |
| 4,450,992 | 5/1984 | Casull | 224/912 |

*Primary Examiner*—Deborah L. Kyle
*Assistant Examiner*—Michael J. Carone
*Attorney, Agent, or Firm*—Paul F. Horton

[57] ABSTRACT

A revolver holder for revolvers of the type having a cylinder retention pin which includes a spring biased keeper. The holder includes a plate member defining a recess for placement of the cylinder; a first stud operable to engage the back of the hammer; a second stud operable to engage the frame; and a third stud provided with an aperture for receiving the keeper. A keeper engagement pin reciprocally movable within the aperture is pushed to dislodge the spring biased keeper from the aperture for removal of the revolver from the holder. The third stud also may include a stud placement adjustment for adapting to revolvers having slightly different dimensions. The first and second studs may be provided with shoulders to prevent contact between the frame, cylinder, and barrel of the revolver with the holder. Proper spacing of the studs prevents mounting of the revolver onto the holder when the hammer chamber of the cylinder contains a cartridge.

20 Claims, 1 Drawing Sheet

REVOLVER HOLDER

BACKGROUND OF THE INVENTION

1. Field of the Invention

This invention relates, in general, to handgun holders and, more particularly, to a holder for those revolvers provided with a cylinder retention pin having a spring biased keeper.

2. Description of the Prior Art

Handgun holders for small handguns and revolvers are well known. Many are in the form of buckles or have buckle attachments for wearing the handgun on the person. Holders are also desirable for purposes of display, storage, safety, and convenience.

Some holders, such as those invention by L. S. Flatau, U.S. Pat. Nos. 252,448 and R. J. Casull, U.S. Pat. No. 4,450,992, require modification of the handgun for usage. Others, as typified by patents issued to J. W. Ryan, U.S. Pat. No. 3,026,642; S. L. Leaver, U.S. Pat. No. 4,260,087, and B. D. Bockoven, U.S. Pat. No. 4,377,249, utilize spring clips or covers for holding the handgun to a retention plate or buckle. In all known holders, the gun is brought into direct contact with the plate which results in scratches on the hardware of the gun.

SUMMARY OF THE INVENTION

The revolver holder of the present invention requires no modification of the revolver and utilizes no spring clips or covers, but is novel in utilizing a spring loaded component of the revolver—spring biased keeper of the cylinder retention pin—as the spring component of a latch holding the revolver to a plate. Another point of novelty is the use of shouldered studs, co-operating with an apertured stud, to hold the revolver from contact with the plate. A third object of the present invention is a safety feature which prevents the mounting of the revolver to the plate when a cartridge is in the hammer chamber of the cylinder of the revolver. A complete description of the revolver holder of the present invention may be found in the appended claims.

DETAILED DESCRIPTION OF THE INVENTION

Figure 1:
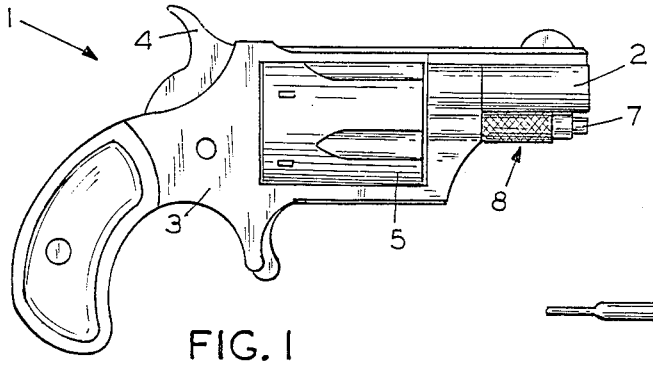
FIG. 1 is a side view of the type of revolver for which the holder of the present invention is designed.
Figure 2:
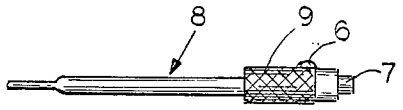
FIG. 2 is a side view of the cylinder retention pin of the revolver shown in FIG. 1.

Referring to the drawings, and first to FIG. 1, the type of revolver useable with the holder of the present invention is shown. Revolver 1 includes, generally, a frame 3, hammer 4, cylinder 5 and a barrel 2. Revolver 1, for use with the holder of the present invention, must also include a cylinder retention pin 8, having a spring biased keeper 7, shown to advantage in FIG. 2. A compression spring, not shown, within housing 9 of the pin, forces keeper 7 in an outward protruding position. A ball bearing 6, held in housing 9, engages a hemispherical recess on the bottom of barrel 2 to hold the pin in place. Pushing keeper 7 into housing 9 against the force of the spring causes ball bearing 6 to recede into a cavity within keeper 7 to release the ball bearing from the barrel recess so that pin 8 can be withdrawn from the revolver to free the cylinder for removal.

Referring now to FIGS. 3–6, one preferred embodiment of a revolver holder 10, made according to the present invention, is disclosed. Holder 10 includes, generally, a plate 20; hammer engagement means 30; frame engagement means 40; and keeper engagement means 50.

Plate 20 may be constructed of any suitable material; aluminum, stainless steel, or high-impact thermoplastic being preferred. The plate includes a front face 21 and a rear face 22, the faces preferably being substantially planar and parallel with one another and the plate having a thickness of approximately one-quarter inch. It will be noted that the area of the plate is substantially less than the side area of the revolver. On its front face, the plate defines a recess 23 for receiving one side of cylinder 5 of the revolver.

Hammer engagement means 30, which may take several forms, preferably comprises a first stud 35 upstanding from the plate and integral with or otherwise attached to the plate by threads, welding, or the like. Stud 35 includes a bottom shoulder 34 and a top shoulder 36; the shoulders being separated at a sufficient distance to engage opposing side surfaces of hammer 4.

Likewise, frame engagement means 40, which also may take several forms, preferably comprises a second stud 45, upstanding from the plate and similarly attached to the plate. Stud 45 is attached at the lowermost end of the plate and also includes a pair of spaced shoulders, bottom shoulder 44 and top shoulder 46. Shoulders 44 and 46 are spaced at a distance to snugly engage opposing side surfaces of frame 3 at or adjacent to the grip portion of the frame.

Figure 6:
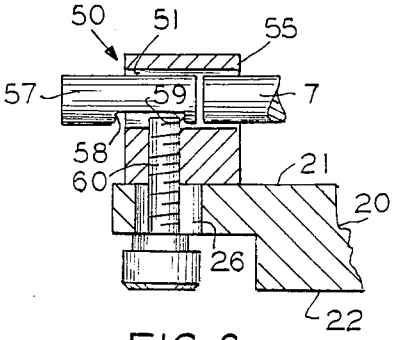
FIG. 6 is a sectional view of the keeper engagement means of the holder shown in FIG. 3.

Keeper engagement means 50 is also preferably in the form of a stud, third stud 55, attached to and upwardly standing from plate 20. Stud 55, shown to advantage in FIG. 6, includes a cylindrical aperture 51 extending therethrough transverse to the longitudinal axis of the stud and in alignment with keeper 7 of revolver 1. The aperture has a diameter slightly larger than that of the keeper. Mounted within aperture 51 is a substantially cylindrical keeper detachment pin 57 which slidingly and reciprocally engages the walls of the aperture to engage keeper 7. Pin 57 is retained within aperture 51 by a substantially flat recessed portion defining a pair of stops 58 and 59, which engage the top portion of a stud adjustment screw 60 which threadably engages stud 55 through an elongated slot 26 in plate 20. It will be seen, then, that stud 55 may be moved lengthwise of plate 20 a short distance and tightened in place to accommodate revolvers having slightly different lengths. Such an adjustment means also permits "fine tuning" of the stud and hence aperture 51 for reception of keeper 7. So as not to expose the head of adjustment screw 60, the plate may be recessed, as shown in FIG. 6.

Figure 4:
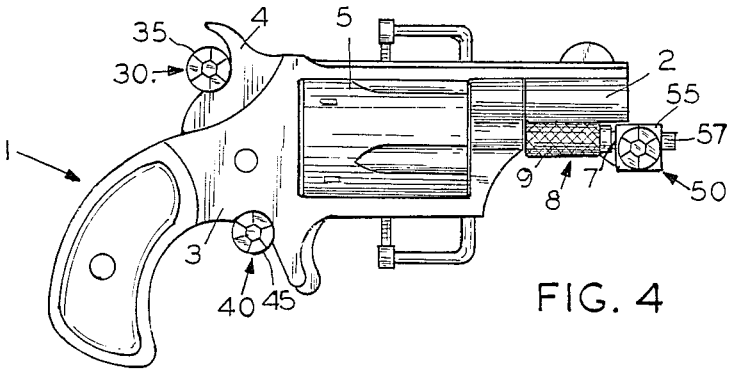
FIG. 4 is a side view showing a revolver mounted onto the holder shown in FIG. 3.

Referring now to FIG. 4, it will be seen that hammer engagement means 30, comprising stud 35; frame engagement means 40, comprising stud 45; and stud 55, with aperture 51 receiving the spring biased keeper 7 of revolver 1, closely engage the revolver. Proper positioning of the studs into close tolerance with the parts of the revolver make it impossible to mount the revolver when the hammer is in a partially cocked position, as it must be when a cartridge is in the hammer chamber of cylinder 5; the hammer chamber being that chamber which has been rotated to be in alignment with the hammer. This is an added safety feature of the present invention. Studs 35, 45, and 55 may include decorations or be jeweled for aesthetic reasons.

Figure 3:
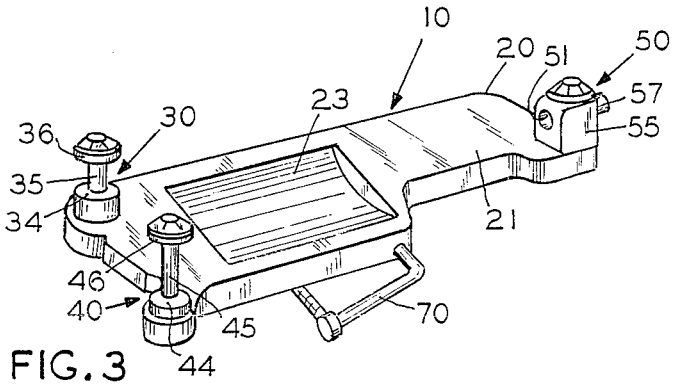
FIG. 3 is a perspective view of the holder of the present invention, shown including a belt buckle.

Referring now to FIG. 3, it will be seen that if the shoulders of the studs 35 and 45 and the aperture 51 of stud 55 are raised at a selected and sufficient distance above the front face 21 of plate 20, that the revolver will be spaced, when mounted, a slight distance above the surface of the plate to prevent contact between the plate and the revolver, thus preventing any marring or scratching of the surface of the revolver.

Figure 5:
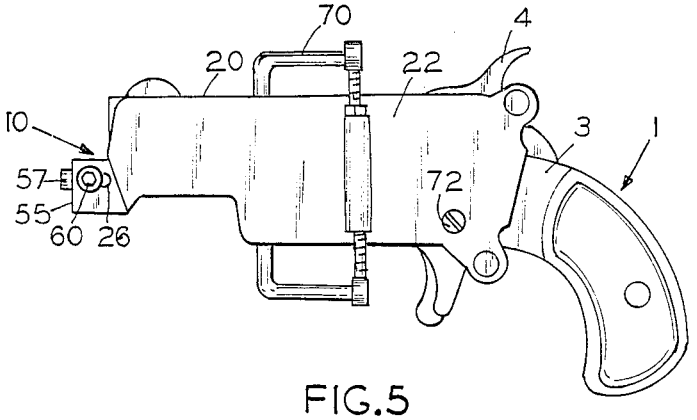
FIG. 5 is a rear view of the holder with revolver.

While holder 20 may be used for any desirable purpose, such as for display or for safe storage, it is contemplated that the plate may, on its rear face, be provided with threaded apertures for mounting on other objects; may include an attached pin for wearing upon the person; or, as shown to advantage in FIG. 5, may include a loop buckle 70 received within opposing bores at the top and bottom of the plate, or otherwise be attached, and may also include a prong member 72 outwardly extending from the rear face of the plate for engaging a belt.

To mount revolver 1 onto holder 10, the revolver is slipped between studs 35 and 45 with the back of hammer 4 engaging stud 35 and opposing sides of the hammer resting between shoulders 34 and 36, and with the frame 3 engaging stud 45 and opposing sides of the frame resting between shoulders 44 and 46 of the stud. Spring biased keeper 7 is then compressed backward into housing 9 of cylinder retention pin 8, the keeper brought into alignment with aperture 51 of stud 55, and the keeper is then released for reception into the aperture so that the revolver is held tightly in place above the surface of front face 21 of plate 20. If needed, adjustment screw 60 may be loosened to permit stud 55 to be moved forward or backward relative to keeper 7 for a tight fit. For removal of the revolver from the holder, keeper detachment pin 57 is simply compressed into engagement with keeper 7, forcing the spring biased keeper back within housing 9 of cylinder retention pin 8, thus freeing the keeper from aperture 51 of stud 55, and the revolver is then pulled slightly outward from the plate and forward to free the revolver from studs 35 and 45.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A revolver holder for revolvers having a frame, hammer, and cylinder and further provided with a cylinder retention pin having a spring biased keeper, said holder comprising:

a plate having a front face and a rear face;

hammer engagement means upstanding from the front face of said plate for engaging the hammer;

frame engagement means upstanding from the front face of said plate for engaging the frame; and keeper engagement means upstanding from the front face of said plate for engaging said keeper to hold the revolver in a fixed mounted relationship relative to said plate.

2. The holder as described in claim 1 wherein said hammer engagement means comprises a first stud.

3. The holder as described in claim 1 wherein said frame engagement means comprises a second stud.

4. The holder as described in claim 1 wherein said keeper engagement means comprises a third stud.

5. The holder as described in claim 4 wherein said third stud is provided with an aperture for receiving the spring biased keeper.

6. The holder as described in claim 5 further comprising third stud placement adjustment means.

7. The holder as described in claim 5 wherein said third stud is provided with a keeper detachment pin, slidably received within said aperture for engaging and compressing the keeper for removal of the revolver from the holder.

8. The holder as described in claim 1 wherein said plate defines a recess on its front face for receiving the cylinder.

9. The holder as described in claim 1 wherein said hammer engagement means, frame engagement means and keeper engagement means are spaced in such close apposition to one another so as to prevent mounting of the revolver onto the holder with a cartridge in the hammer chamber of the cylinder.

10. The holder as described in claim 1 wherein said plate is provided with a belt buckle.

11. A revolver holder for revolvers having a frame, hammer, and cylinder and further provided with a cylinder retention pin having a spring biased keeper, said holder comprising:

a plate having a front face and a rear face and defining a recess on the front face for receiving the cylinder;

a first stud upstanding from the front face of said plate for engaging the hammer;

a second stud upstanding from the front face of said plate for engaging the frame; and a third stud upstanding from the front face of said plate, said stud provided with an aperture for receiving the spring biased keeper.

12. The holder as described in claim 11 wherein said third stud is provided with keeper detachment means for removal of the keeper from said aperture for removal of the revolver from the holder.

13. The holder as described in claim 12 wherein said keeper detachment means comprises a pin slidably received within said aperture for engaging and compressing the keeper for removal of the keeper from said aperture.

14. The holder as described in claim 11 wherein said first and second studs are each provided with spaced shoulders operable to engage opposing sides of the hammer and frame respectively and wherein said aperture of said third stud is spaced parallel and above the front face of said plate at such a distance so as to prevent contact between the revolver and the plate.

15. The holder as described in claim 11 further comprising a belt buckle attached to said plate.

16. The holder as described in claim 11 wherein said third stud includes placement adjustment means.

17. The holder as described in claim 11 wherein said first stud, second stud, and third stud are spaced in such close apposition to one another so as to prevent mounting of the revolver onto the holder with a cartridge in the hammer chamber of the cylinder.

18. A revolver holder for revolvers having a frame, hammer, and cylinder and further provided with a cylinder retention pin having a spring biased keeper, said holder comprising:

a plate having a front face and a rear face and defining a recess on the front face for receiving the cylinder;

a first stud upstanding from the front face of said plate, said stud provided with spaced shoulders for engaging opposing side surfaces of the hammer;

a second stud upstanding from the front face of said plate, said second stud provided with spaced shoulders for engaging opposing side surfaces of the frame; and a third stud upstanding from the front face of said plate, said stud provided with an aperture for receiving the spring biased keeper and a keeper detachment pin slidably received within said aperture for engaging and compressing the keeper for removal of the keeper from said aperture and hence said revolver from the holder.

19. The holder as described in claim 18 further comprising third stud placement adjustment means.

20. The holder as described in claim 19 wherein said first and second studs are each provided with spaced shoulders operable to engage opposing sides of the hammer and frame, respectively, and wherein said aperture of said third stud is spaced at such a distance above said plate so as to prevent contact between the revolver and the plate once the revolver is mounted.

* * * * *